US008226824B2

(12) United States Patent
Mondschein et al.

(10) Patent No.: US 8,226,824 B2
(45) Date of Patent: Jul. 24, 2012

(54) ANTI-CLOGGING DRAINAGE INLET

(76) Inventors: Brian E. Mondschein, Raleigh, NC (US); Mark J. Magrath, Raleigh, NC (US)

( * ) Notice: Subject to any disclaimer, the term of this patent is extended or adjusted under 35 U.S.C. 154(b) by 205 days.

(21) Appl. No.: 12/654,265

(22) Filed: Dec. 15, 2009

(65) Prior Publication Data

US 2011/0139694 A1 Jun. 16, 2011

(51) Int. Cl.
*E03F 5/06* (2006.01)

(52) U.S. Cl. ..... 210/131; 210/156; 210/163; 210/164; 210/254; 404/4

(58) Field of Classification Search ..... 210/131, 210/156, 163, 164, 170.03, 254; 404/4, 5
See application file for complete search history.

(56) References Cited

U.S. PATENT DOCUMENTS

| | | | | |
|---|---|---|---|---|
| 2,615,526 | A * | 10/1952 | Lane | 210/164 |
| 5,133,619 | A | 7/1992 | Murfae et al. | |
| 6,086,758 | A * | 7/2000 | Schilling et al. | 210/164 |
| 6,217,756 | B1 * | 4/2001 | Martinez | 210/163 |
| 6,368,499 | B1 * | 4/2002 | Sharpless | 210/164 |
| 6,531,059 | B1 * | 3/2003 | Morris et al. | 210/164 |
| 6,726,402 | B1 * | 4/2004 | Martinez | 210/163 |
| 6,733,665 | B1 * | 5/2004 | Khalil | 210/163 |
| 6,837,652 | B1 | 1/2005 | Rost et al. | |
| 6,869,523 | B2 * | 3/2005 | Martinez | 210/156 |
| 7,112,274 | B1 * | 9/2006 | Sanguinetti | 210/163 |
| 7,201,843 | B2 | 4/2007 | Sasaki et al. | |
| 7,238,279 | B2 * | 7/2007 | Saurenman et al. | 210/131 |
| 2003/0047497 | A1 * | 3/2003 | Harris et al. | 210/163 |
| 2005/0183997 | A1 * | 8/2005 | Happel et al. | 210/163 |
| 2006/0049085 | A1 | 3/2006 | Parker | |
| 2006/0102543 | A1 | 5/2006 | Peters et al. | |
| 2008/0251470 | A1 * | 10/2008 | Kent | 210/163 |

* cited by examiner

*Primary Examiner* — Christopher Upton
(74) *Attorney, Agent, or Firm* — Richard C. Litman

(57) ABSTRACT

The anti-clogging drainage inlet is adapted for use in lawn or field environments that require drainage systems to prevent flooding or unwanted pooling during periods of rain. The inlet includes a grate mounted to a rectangular frame. The frame and the grate are adapted to be positioned in the opening of a conventional drainage box in a manner that the top surface of the grate is flush with the surface of the lawn or field. A linkage system is mounted to the frame and grate and operates to raise the grate from its flush position. The linkage system includes a container positioned below the grate and within the drainage box.

4 Claims, 5 Drawing Sheets

ANTI-CLOGGING DRAINAGE INLET

BACKGROUND OF THE INVENTION

1. Field of the Invention

The present invention generally relates to filtering assemblies, particularly for landscaping area drains, and more particularly to an anti-clogging drainage inlet.

2. Description of the Related Art

Providing drainage assemblies for lawn or field areas has heretofore presented problems in that the drainage assemblies frequently become clogged with debris (leaves, dirt, trash, etc.). The clogged drain prevents proper water run-off causing pooling or flooding in the lawn or field surrounding the assembly. Such pooling and/or flooding can cause damage to the lawn or field and to structures that may be positioned thereon. The art would certainly welcome a drainage assembly that could withstand an exceptional flow of debris, yet still function to reliably drain water from surrounding areas. Thus the anti-clogging drainage inlet solving the aforementioned problems is desired.

SUMMARY OF THE INVENTION

The anti-clogging drainage inlet is contemplated for use in lawn or field environments that require drainage systems to prevent flooding or unwanted pooling during periods of rain. It should be noted however, that the inlet could be adapted for use in other environments, i.e., drainage channels for roof gutters, prevention of clogging in existing piping systems and the like. The drainage inlet comprises inlet structure including a grate and a container mounted to a rectangular frame. The frame and the inlet structure are adapted to be positioned in the opening of a conventional drainage box so that the top surface of the grate is flush with the surface of the lawn or field. A linkage system is mounted to the frame and inlet structure and operates to raise the grate from its flush position. The container is fabricated from a perforated material and is positioned below the grate and within the interior of the drainage box.

In its flush position, the grate functions to prevent relatively large pieces of trash and debris from entering the drainage box and clogging the overall drainage system. During periods of excessive flow, the container will fill with water and relatively small pieces of debris. The increased weight will cause the linkage system to pivot and raise the grate. As water flows through the perforated material, the weight of the container is reduced and the grate will return to its flush position. However, if the amount of debris in the container is of an amount to maintain the pivoting weight, the grate will remain in a raised position as an indication that the container should be cleaned out.

Accordingly, the anti-clogging drainage inlet is conveniently adaptable to existing drainage systems. The invention is rugged in design and easy to maintain. The invention provides for improved elements thereof in an arrangement for the purposes described that are inexpensive, dependable and fully effective in accomplishing their intended purposes.

A clear understanding of the present invention will become readily apparent upon further review of the following specification and drawings.

DETAILED DESCRIPTION OF THE PREFERRED EMBODIMENTS

Figure 1:
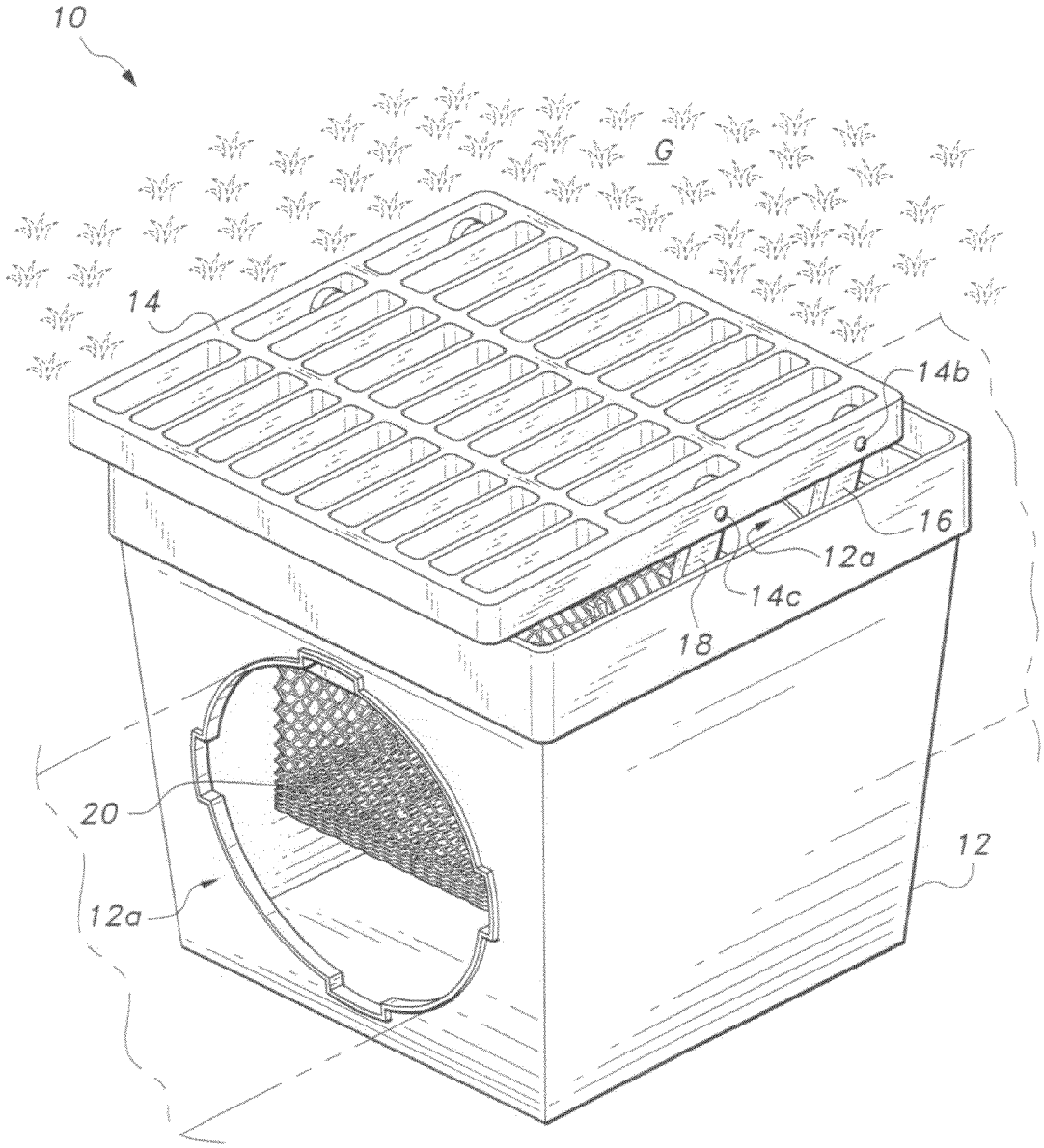
FIG. 1 is an environmental, perspective view of an anti-clogging, drainage inlet according to the present invention.
Figure 2:
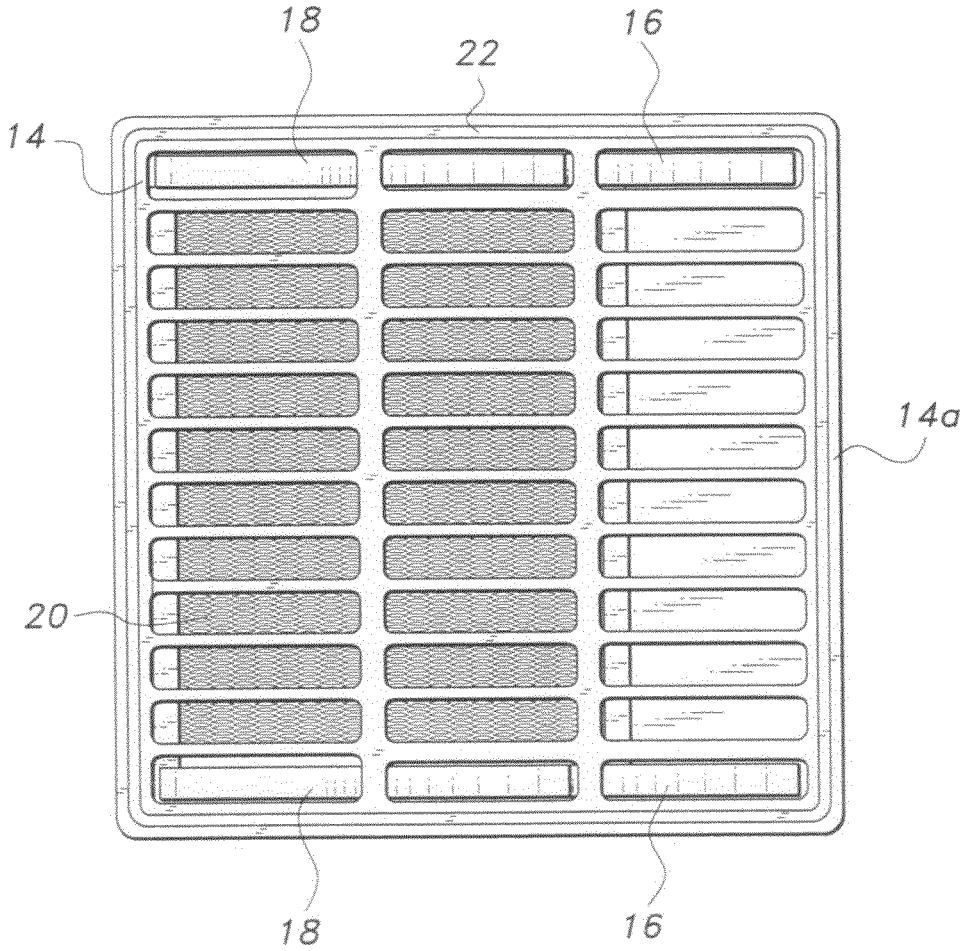
FIG. 2 is a top view of an anti-clogging, drainage inlet according to the present invention.
Figure 3:
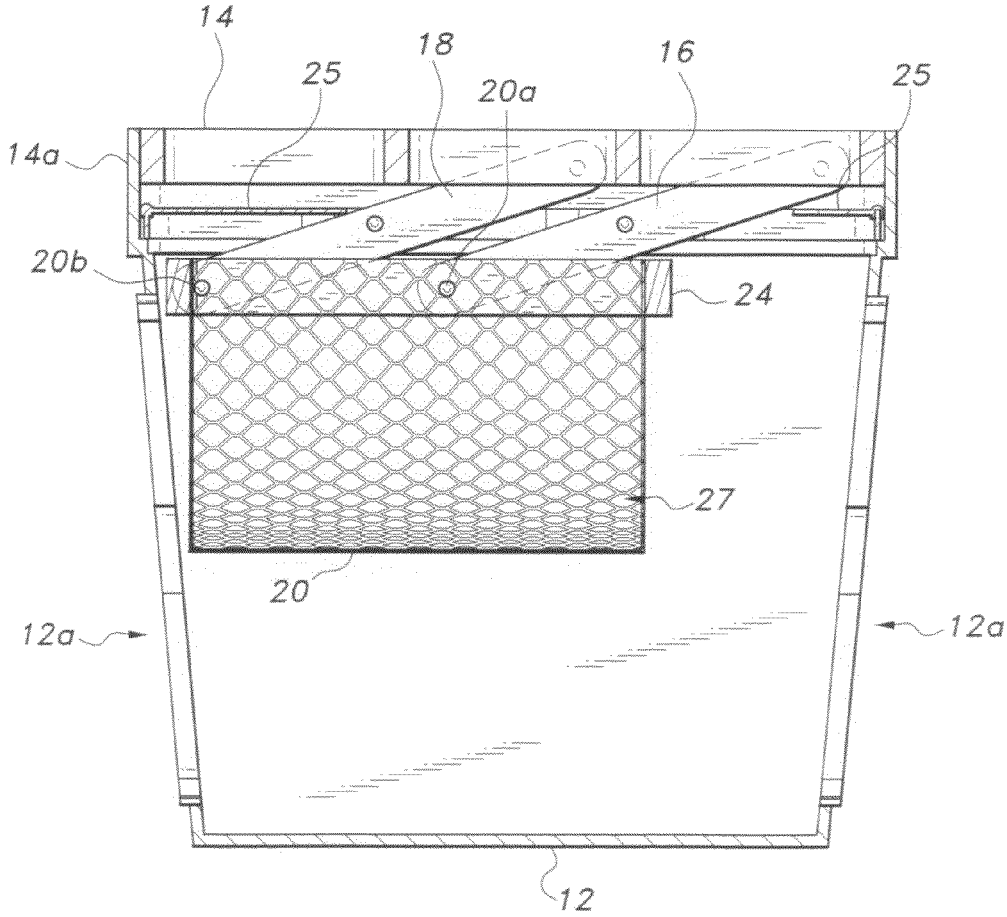
FIG. 3 is a sectional view of an anti-clogging, drainage inlet according to the present invention, with the grate in its lowered position.
Figure 4:
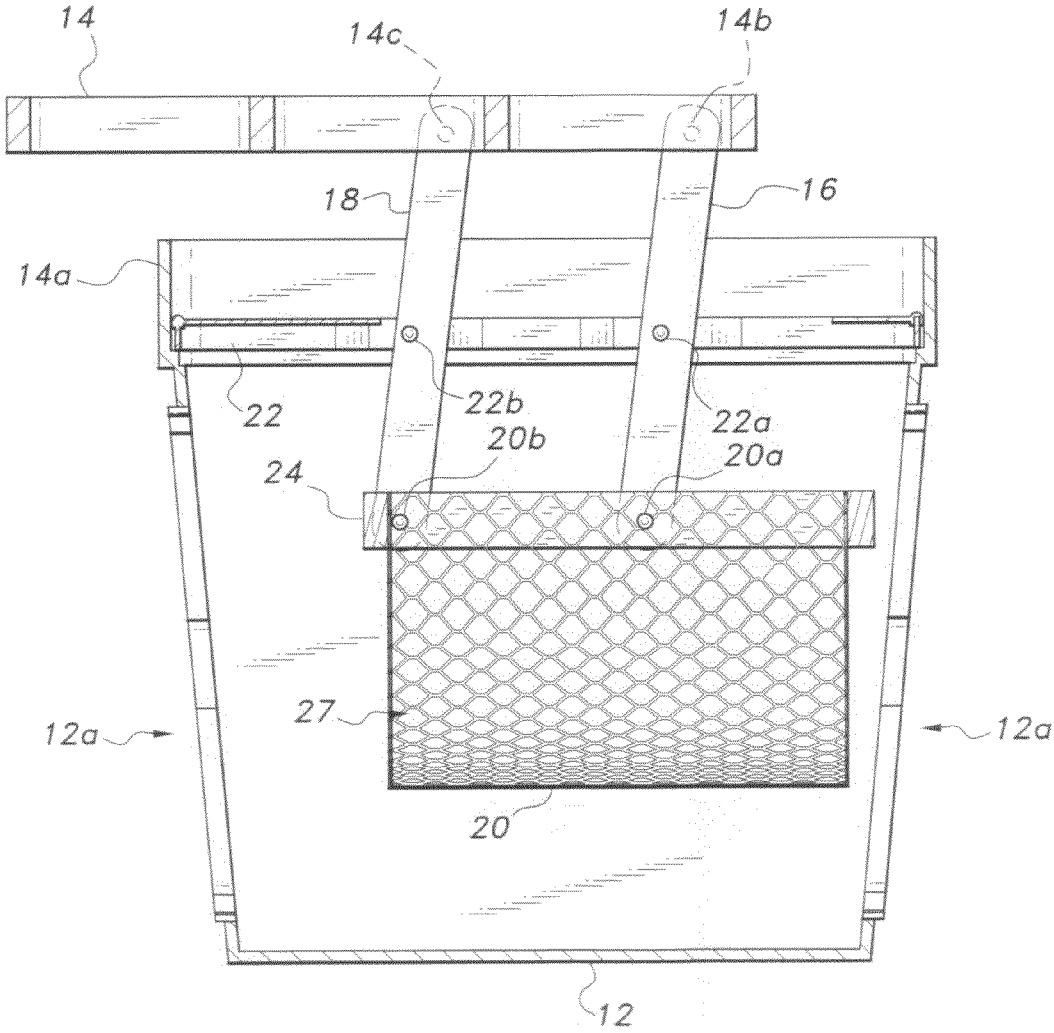
FIG. 4 is a sectional view of an anti-clogging, drainage inlet according to the present invention, with the grate in its raised position.
Figure 5:
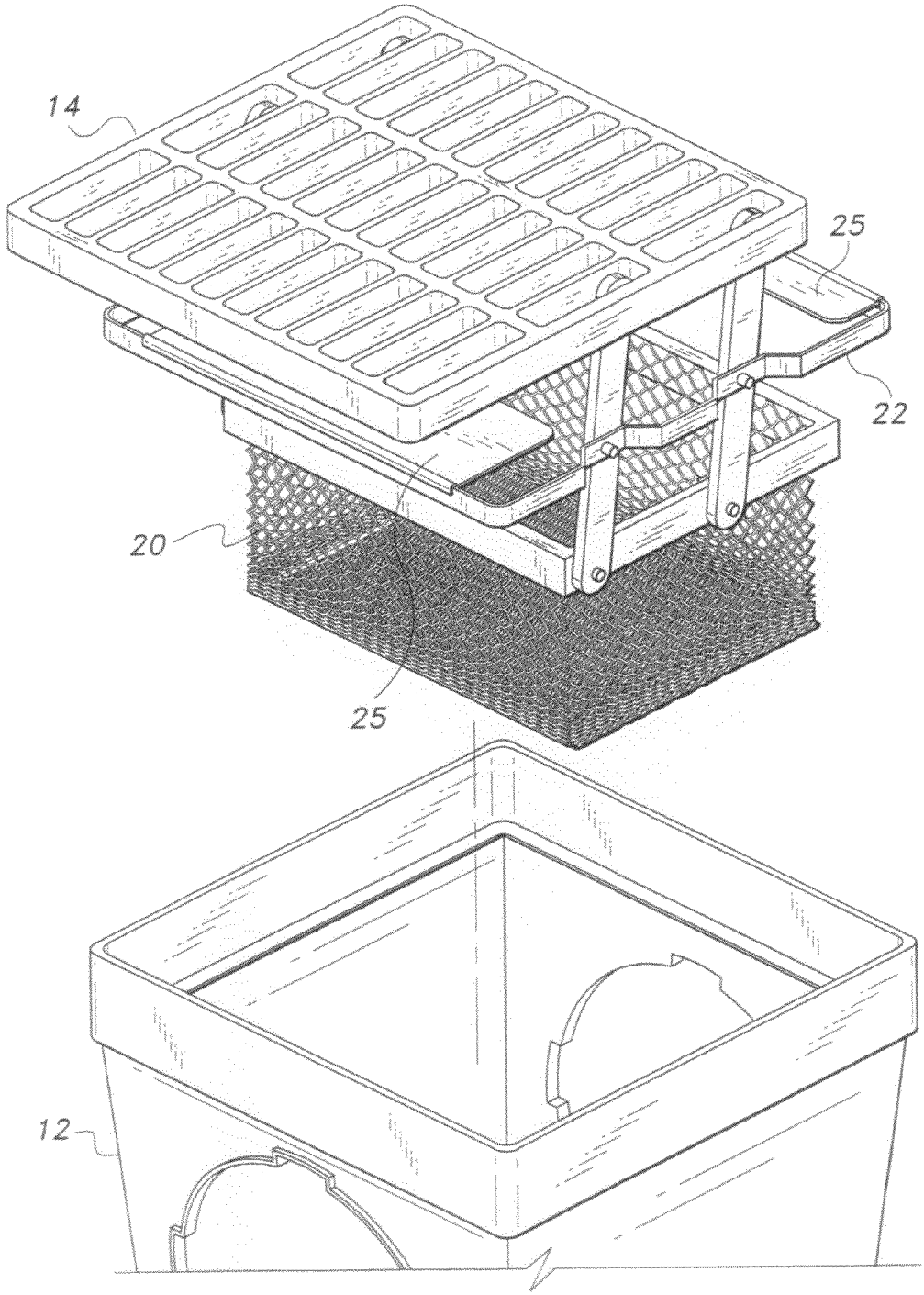
FIG. 5 is an exploded view of an anti-clogging, drainage inlet according to the present invention Similar reference characters denote corresponding features consistently throughout the attached drawings.

Referring to FIGS. 1-4 wherein the anti-clogging drainage inlet 10 is disposed atop a conventional drainage box 12. The box 12 is positioned beneath the surface of the ground G of a lawn or field. The drainage box 12 has openings 12*a* therein for receiving a drain duct (shown in phantom lines). The drainage inlet 10 is configured to nest in the drainage box 12.

The drainage inlet 10 comprises a grate member 14 configured as an open grid. A linkage system is attached to the grate 14. The linkage system comprises a first pair of legs 16 having proximate ends pivotally attached at 14*b* adjacent to a first end of the grate 14 at each side thereof (only one leg 16 is shown in the section views of FIGS. 3 and 4). The distal ends of first legs 16 are pivotally attached to a lower positioned rectangular frame member 24 at 20*a*. A second pair of legs 18 has proximate ends pivotally attached to the grate 14 at 14*c*. The distal ends of the legs 18 are pivotally attached to lower positioned rectangular frame member 24 at 20*b*.

An upper positioned rectangular frame member 22 is coextensive with and rests on a ledge 14*a* formed on drainage box 12. At approximately midway their lengths, the legs 16 and 18 are pivotally attached to respective sides of the upper positioned rectangular frame member 22 at 22*a* and 22*b*. A rectangular container 20 is fabricated from expanded metal or the like and is configured with sidewalls, end walls, a bottom wall and an open top. The rectangular frame member 24 encompasses the walls of the container and is attached thereto at the open top. The sidewalls, end walls, and bottom wall of the container 20 are provided with graduated openings 27. Openings 27 increase in size from the bottom to the top of the container 20. Plates 25 are attached on opposite sides of frame member 22 and partially extend over container 20. Plates 25 function to funnel water and debris into the container rather than having such water and debris bypass the container.

As discussed above, in its lowered position (shown in FIG. 3), the grate 14 will prevent large pieces of debris from entering the opening in the drainage box 12. During periods of high rates of water flow, the container 20 will fill with water and small pieces of debris, and the combined weights will cause the container 20 to drop and pivot the grate 14 to a raised position (shown in FIG. 4). As noted above, the grate 14 will remain in a raised position as an indication that the container 20 should be cleaned.

It is to be understood that the present invention is not limited to the embodiments described above, but encompasses any and all embodiments within the scope of the following claims.

We claim:

1. An anti-clogging drainage inlet, comprising:

an open grid grate member, the grate member having opposing side edges;

a first frame member positioned below the grate member;

a second frame member positioned below the first frame member;

a linkage system directly connected to the grate, the first frame member and the second frame member, the linkage system having a plurality of legs on each of the side edges of the grate member, each of the legs having upper and lower ends, wherein each of the legs being pivotally attached to: the grate member adjacent their upper ends, the first frame member intermediate the upper and lower ends, and the second frame member adjacent their lower ends; and a container, the container having sidewalls, end walls, a bottom wall and an open top, the container being disposed beneath the grate member and extending downwardly from the second frame member, wherein the open top is adjacent the second frame member, further wherein the container having a plurality of openings defined therein.

2. The anti-clogging drainage inlet according to claim 1, further including plate members attached to said first frame member and partially extending over the open top of said container.

3. The anti-clogging drainage inlet according to claim 2, wherein said container is fabricated from expanded metal.

4. The anti-clogging drainage inlet according to claim 1, wherein the plurality openings being graduated in size from smaller to larger from the bottom wall to the open top.

* * * * *